US006607415B2

(12) United States Patent
Dunfield et al.

(10) Patent No.: US 6,607,415 B2
(45) Date of Patent: Aug. 19, 2003

(54) METHOD FOR FABRICATING TINY FIELD EMITTER TIPS

(75) Inventors: John Stephen Dunfield, Corvallis, OR (US); Donald J. Milligan, Corvallis, OR (US); Paul H. McClelland, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 211 days.

(21) Appl. No.: 09/880,158

(22) Filed: Jun. 12, 2001

(65) Prior Publication Data

US 2002/0185948 A1 Dec. 12, 2002

(51) Int. Cl.[7] ..... H01J 1/304; H01J 9/02
(52) U.S. Cl. ..... 445/50; 438/20
(58) Field of Search ..... 445/24, 50; 438/20

(56) References Cited

U.S. PATENT DOCUMENTS

| | | | | |
|---|---|---|---|---|
| 5,090,932 A | | 2/1992 | Dieumegard et al. | 445/24 |
| 5,557,596 A | | 9/1996 | Gibson et al. | 369/101 |
| 6,008,576 A | | 12/1999 | Nakatani et al. | 313/495 |
| 6,057,172 A | | 5/2000 | Tomihari | |
| 6,096,570 A | | 8/2000 | Hattori | 438/20 |
| 6,137,212 A | | 10/2000 | Liu et al. | 313/308 |
| 6,350,388 B1 | * | 2/2002 | Knappenberger et al. | 216/42 |
| 6,420,086 B1 | * | 7/2002 | Yang et al. | 430/270.1 |
| 6,524,874 B1 | * | 2/2003 | Alwan | 438/20 |

FOREIGN PATENT DOCUMENTS

| | | |
|---|---|---|
| EP | 0379298 | 7/1990 |
| EP | 0731490 | 9/1996 |
| WO | WO99/62106 | 12/1999 |

OTHER PUBLICATIONS

"Fabrication Of Sub–10 nm Silicon Tips: A New Approach"; by: Huq, et al; XP 000558344; Journal Of Vacuum Science And Technology; B 13(6); Nov./Dec. 1995; pp. 2718–2721.
"Procedes de Fabrication De Micropointes En Silicium"; by: Moreau, et al; Sciences Et Techniques; XP000637302; 1996; No. 282; vol. 52; ISSN: 1266–0167; pp. 463–477.

* cited by examiner

*Primary Examiner*—Kenneth J. Ramsey

(57) ABSTRACT

A method for fabricating tiny field emitter tips across the surface of a substrate. A substrate is first exposed to reactive molecular, ionic, or free radical species to produce nanoclusters within a thin surface layer of the substrate. The substrate may then be thermally annealed to produce regularly sized and interspaced nanoclusters. Finally, the substrate is etched to produce the field emitter tips.

18 Claims, 5 Drawing Sheets

METHOD FOR FABRICATING TINY FIELD EMITTER TIPS

TECHNICAL FIELD

The present invention relates to flat surfaces that emit electrons in localized areas to which an electrical field of threshold magnitude is applied and, in particular, to fabrication of tiny field emitter tips across the surface of a substrate that provides functionality intermediate between thin-film field emitters and field emitter tip microarrays.

BACKGROUND OF THE INVENTION

The present invention relates to design and manufacture of field emitter tips, including silicon-based field emitter tips. A brief discussion of field emission and the principles of design and operation of field emitter tips is therefore first provided in the following paragraphs, with reference to FIG. 1.

When a wire, filament, or rod of a metallic or semiconductor material is heated, electrons of the material may gain sufficient thermal energy to escape from the material into a vacuum surrounding the material. The electrons acquire sufficient thermal energy to overcome a potential energy barrier that physically constrains the electrons to quantum states localized within the material. The potential energy barrier that constrains electrons to a material can be significantly reduced by applying an electric field to the material. When the applied electric field is relatively strong, electrons may escape from the material by quantum mechanical tunneling through a lowered potential energy barrier. The greater the magnitude of the electrical field applied to the wire, filament, or rod, the greater the current density of emitted electrons perpendicular to the wire, filament, or rod. The magnitude of the electrical field is inversely related to the radius of curvature of the wire, filament, or rod.

FIG. 1 illustrates principles of design and operation of a silicon-based field emitter tip. The field emitter tip 102 rises to a very sharp point 104 from a silicon-substrate cathode 106, or electron source. A localized electric field is applied in the vicinity of the tip by a first anode 108, or electron sink, having a disk-shaped aperture 110 above and around the point 104 of the field emitter tip 102. A second cathode layer 112 is located above the first anode 108, also with a disk-shaped aperture 114 aligned directly above the disk-shaped aperture 110 of the first anode layer 108. This second cathode layer 112 acts as a lens, applying a repulsive electronic field to focus the emitted electrons into a narrow beam. The emitted electrons are accelerated towards a target anode 118, impacting in a small region 120 of the target anode defined by the direction and width of the emitted electron beam 116. Although FIG. 1 illustrates a single field emitter tip, silicon-based field emitter tips are commonly micro-manufactured by microchip fabrication techniques as regular arrays, or grids, of field emitter tips.

Silicon-based field emitter tips can be micro-manufactured by microchip fabrication techniques as regular arrays, or grids, of field emitter tips. Uses for arrays of field emitter tips include computer display devices. FIG. 13 illustrates a computer display device based on field emitter tip arrays. Arrays of silicon-based field emitter tips 1302 are embedded into emitters 1304 arrayed on the surface of a cathode base plate 1306 and are controlled, by selective application of voltage, to emit electrons which are accelerated towards a face plate anode 1308 coated with chemical phosphors. When the emitted electrons impact onto the phosphor, light is produced. In such applications, the individual silicon-based field emitter tips have tip radii on the order of hundreds of Angstroms and emit currents of approximately 10 nanoamperes per tip under applied electrical field strengths of around 50 Volts.

Recently, a second type of field emission display device has been proposed. FIG. 3 illustrates operation of a field emission display device based on a thin-film, flat field emission material. In this alternative type of field emission display device, a semiconductor substrate 302 is coated with a thin film of a material 304 that emits electrons under the influence of a localized electric field. A suitable electric field is created directly below a region of the field emission material 306 with a microelectronic device fabricated within the silicon substrate 308. Electrons emitted from the region of the thin-film field emission material 306 are accelerated in an electric field towards a phosphor-coated glass substrate 312. Collision of an accelerated electron 314 with the phosphor produces phosphorescent emission of photons that travel through the glass substrate 312 to the retina of a viewer. Various research groups have suggested the use of nitrogen-doped, chemical vapor-deposited diamond films, amorphous carbons films, or various conjugated polymers for use as thin-film field emission materials in the flat field emission display devices, operation of which is illustrated in FIG. 3. However, it has proved difficult to fabricate thin-film field emission materials that are long lasting and that produce acceptable current densities of emitted electrons under the influence of reasonably strong electric fields. Thus, designers and manufacturers of field emission display devices have recognized the need for a flat field emission material that can be incorporated in a semiconductor device for use in flat field emission display devices.

SUMMARY OF THE INVENTION

The present invention provides a method for fabricating a dense field of tiny, silicon-based field emitter tips across the surface of a silicon substrate. The silicon substrate is first subjected to a beam of oxygen or oxygen-containing ions to create clusters of $SiO_2$ within a thin surface region of the silicon substrate. The clusters of $SiO_2$ molecules created by ionic bombardment of the silicon substrate surface may then be coalesced, if necessary, into clusters by thermal annealing or other techniques. Finally, the surface of the silicon substrate is etched to remove the $SiO_2$ clusters, thereby producing a dense field of tiny silicon-based field emitter tips across the surface of the silicon substrate.

DETAILED DESCRIPTION OF THE INVENTION

Figure 1:
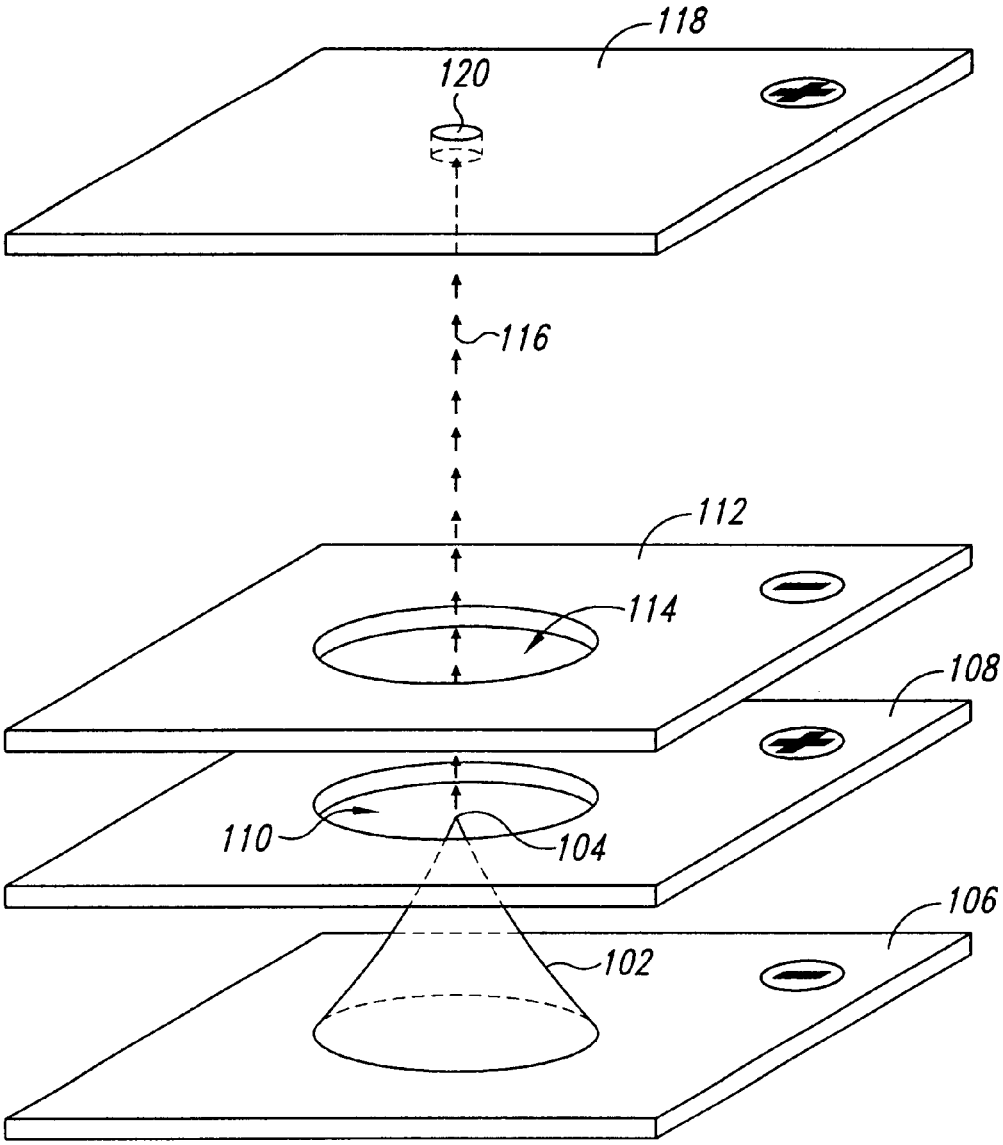
FIG. 1 illustrates principles of design and operation of a silicon-based field emitter tip.
Figure 2:
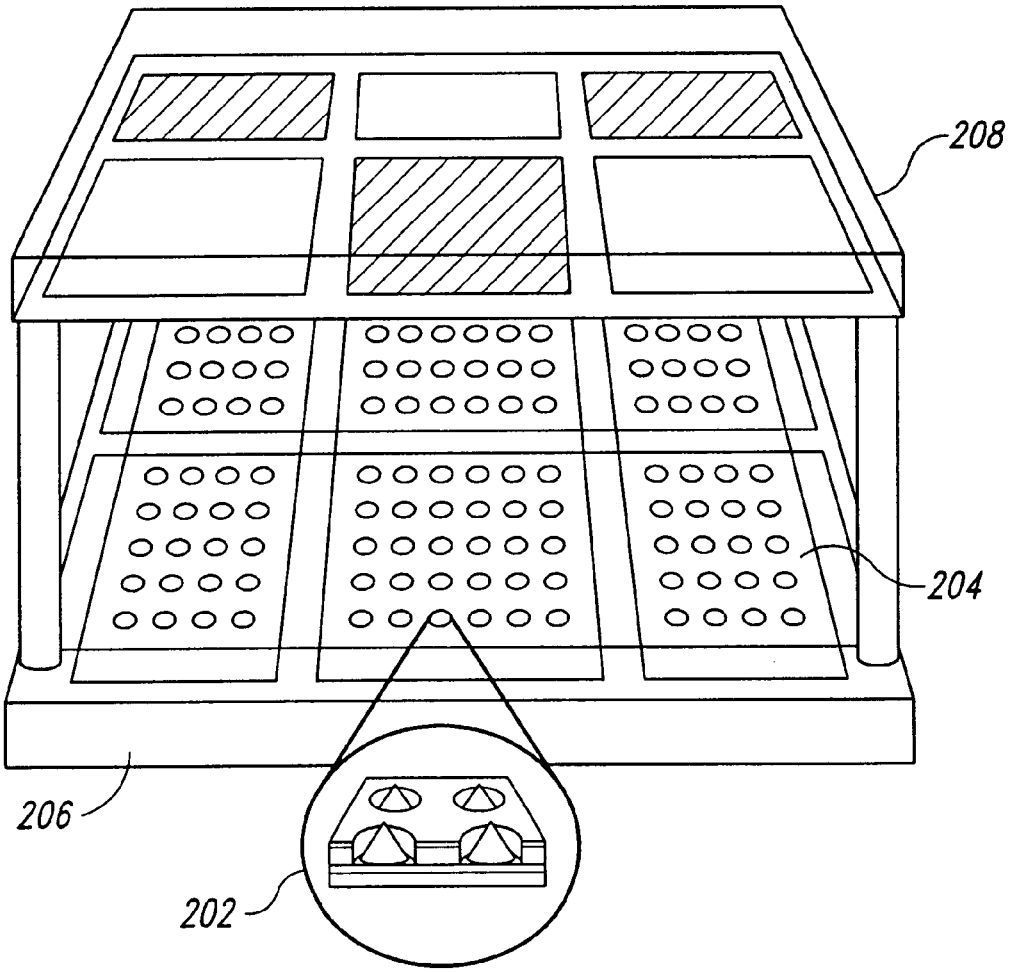
FIG. 2 illustrates a computer display device based on field emitter tip arrays.
Figure 3:
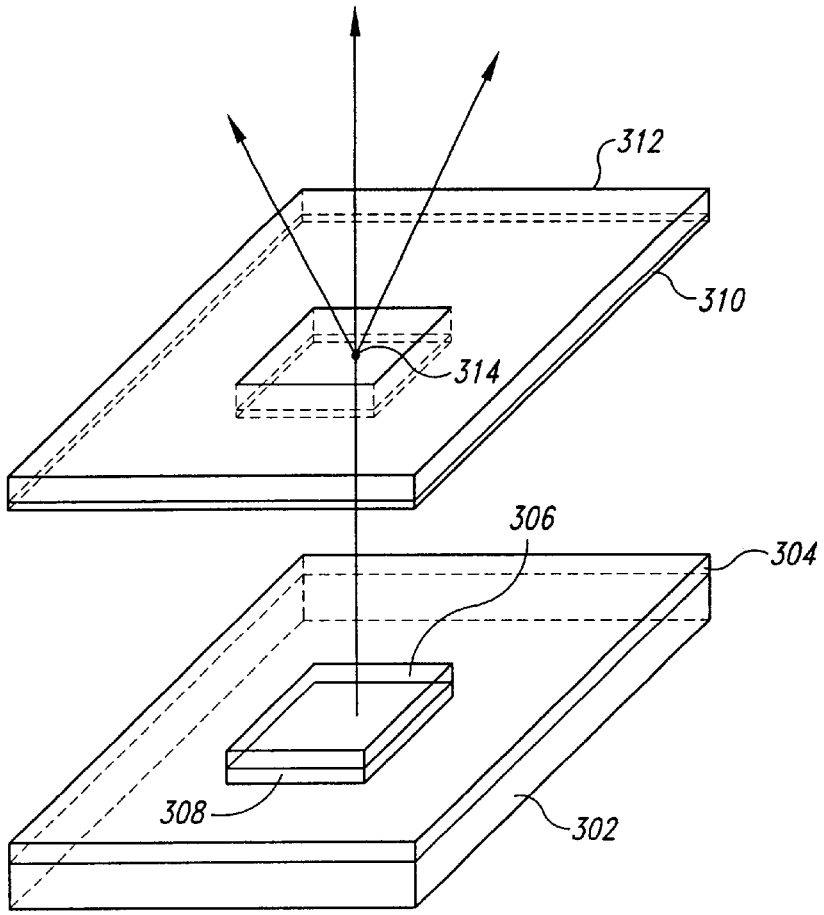
FIG. 3 illustrates operation of a field emission display device based on a thin-film, flat field emission material.
Figure 4:
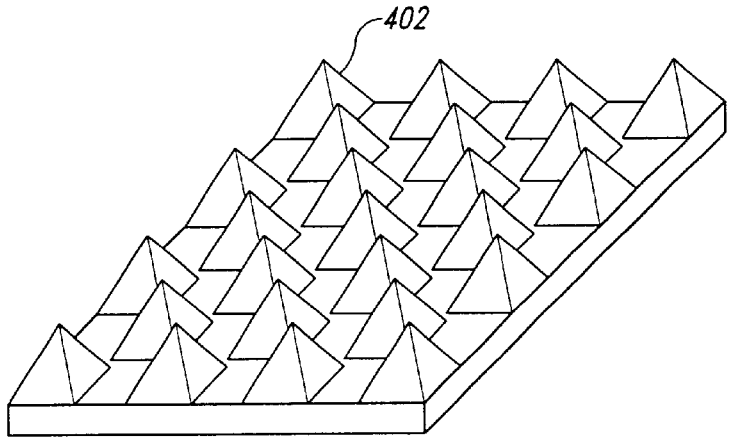
FIG. 4 illustrates a small region of the surface of a silicon substrate viewed with a dense field of tiny, silicon-based field emitter tips.

Silicon-based field emitter tips, such as the micro field emitter tip shown in FIG. 1, produce relatively high current densities under the influence of moderate electric fields and are relatively robust for lengthy periods of electronic emission. Silicon-based micro field emitter tips are, however, relatively expensive to fabricate. Conversely, thin-film field emission materials used in display devices, operation of which are illustrated in FIG. 3, although relatively inexpensive to fabricate, currently appear to be less physically stable than silicon-based field emitter tips, and may produce lower current densities of emitted electrons for a given voltage. One aspect of the present invention is the recognition that these two different technologies can be combined in a dense field of tiny, silicon-based nano field emitter tips that can be fabricated across the surface of a silicon substrate. FIG. 4 illustrates a small region of the surface of a silicon substrate viewed with a dense field of tiny, silicon-based field emitter tips. In FIG. 4, the nanofield emitter tips, such as nanofield emitter tip 402, are shown having very regular sizes, geometries and interspacings, but such precision is not required to produce an effective flat field emission material. Large numbers of silicon-based nano field emitters may be irregularly shaped, defective, or missing without appreciably affecting the bulk emission characteristics of the surface of the silicon substrate.

Figure 5A:
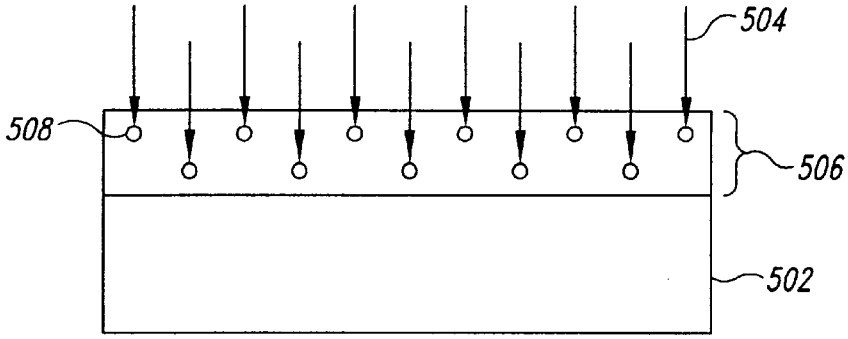
FIGS. 5A–D illustrate a first method for fabricating tiny field emitter tips.

A first embodiment of the present invention provides a relatively inexpensive method for producing tiny field emitter tips across the surface of a substrate material, including substrates, such as a silicon substrate, already containing microfabricated electronic circuits and microelectronic devices. FIGS. 5A–D illustrate, in cross-section, a first method for fabricating tiny field emitter tips. In FIG. 5A, a substrate material 502 is first exposed to reactive ions, indicated in FIG. 5A by arrows, such as arrow 504. The reactive ions are accelerated onto, or diffused into, a surface layer 506 of the substrate, forming covalent bonds with substrate atoms or molecules to produce nanoclusters within the surface layer having a chemical composition different from that of the substrate material. In FIG. 5A, a nanocluster is indicated by a small circle, such nanocluster 508.

When the substrate material is silicon, a variety of different techniques can be used to produce reactive oxygen molecules, including ozone, oxygen-containing ions, or oxygen free radicals, and exposing the substrate material 502 with these active oxygen molecules, ions, or free radicals. These techniques include reactive ion etching ("RIE") methods, electron cyclotron resonance ("ECR") plasma generation, and downstream microwave oxygen plasma generation. Downstream microwave oxygen plasma generation is particularly attractive because it can be used to produce low-temperature oxygen free radicals, so that the silicon substrate need not be exposed to high temperatures during the process. The active oxygen molecules, ions, or free radicals combine with silicon atoms within the silicon substrate to produce $SiO_2$ molecules within the surface layer of the substrate. The $SiO_2$ molecules are produced by exposing the silicon substrate to the reactive oxygen molecules, ions, or free radicals to form tiny $SiO_2$ nanoclusters within the surface layer. The exposure conditions can be controlled to produce a desired density of $SiO_2$ nanoclusters. The depth of the surface layer of the silicon substrate in which the $SiO_2$ nanoclusters are generated may also be determined by controlling various RIE, ECR, or microwave plasma generation parameters such as the acceleration of the reactive oxygen species towards the silicon substrate, the temperature, plasma densities and ion fluxes, and other such parameters. Higher concentrations of $SiO_2$ nanoclusters result in smaller and thinner field emitter tips, and the length of the field emitter tips may be dependant on the depth of the surface layer of the silicon substrate in which $SiO_2$ nanoclusters are generated. Alternatively, reactive nitrogen molecules, ions, or other reactive species may be generated by analogous procedures to produce $Si_3N_4$ nanoclusters within a surface layer of a silicon substrate. As yet another alternative, both reactive oxygen-containing and nitrogen-containing ions may be generated to produce various $Si_xO_yN_z$ nanoclusters, where the subscripts x, y, and z are determined by ion concentration ratios and other process parameters. Both $SiO_2$ and $Si_3N_4$ are commonly used in dielectric insulating layers within finished semiconductor devices as well as for masks during silicon etching steps.

Figure 5B:
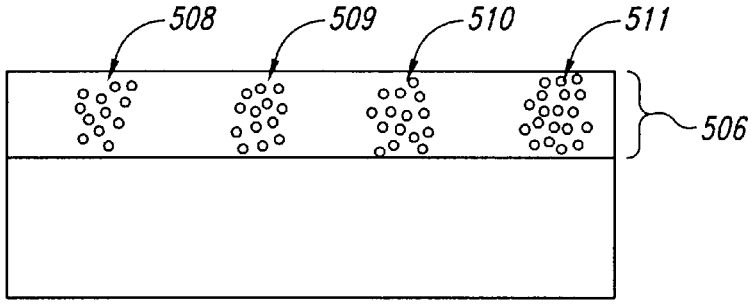

In a second step, in some cases optional, illustrated in FIG. 5B, the silicon substrate may be thermally annealed using rapid thermal processing ("RTP") technologies. The size and density of the nanoclusters within the surface layer 506, produced in the first step, can be altered by heating and cooling the surface layer under controlled conditions. RTP parameters can be chosen to produce relatively regularly spaced nanoclusters of a desired size throughout the surface layer 506. Nanoclusters 508–511, produced by application of RTP to the substrate, are seen to be relatively regularly spaced and have approximately equal sizes. The sizes and spacing of the nanoclusters 508–511 determine the final sizes and spacings between field emitter tips.

Figure 5C:
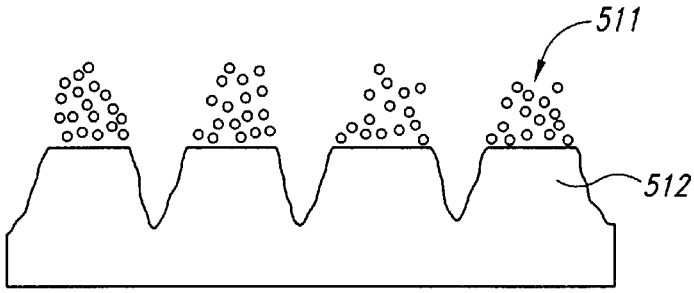

In a third step, the substrate surface layer containing regularly sized and spaced nanoclusters is subjected to various different etch processes to remove substrate material not masked by the nanoclusters. FIG. 5C illustrates an intermediate stage of the etching process. As can be seen in FIG. 5C, the nanoclusters, such as nanocluster 511, serve as tiny, nascent-field-emitter-tip masks that block or inhibit etching of the substrate material below the nanoclusters. Thus, for example, the substrate material 512 below nanocluster 511 is a nascent field emitter tip, formed etching of adjoining substrate material not shielded from the etch medium by the nanocluster. In the case of $SiO_2$ or $Si_3N_4$ nanoclusters within a silicon substrate, RIE etching may be employed using various different gas mixtures, including: (1) $SiH_2Cl_2$, $O_2$ and He or Ar; (2) $NF_3$, $SiF_4$, $O_2$, and He; (3) HBr and Ar.

Figure 5D:
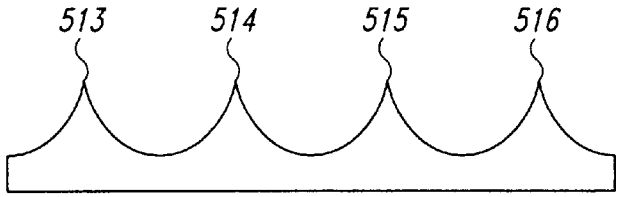

The third etching step may be continued until a final field of tiny field emitter tips is produced across the surface of the substrate. FIG. 5D illustrates a portion of a final field of tiny field emitter tips. In certain cases, continued etching eventually removes the nanocluster masks, so that no additional step is necessary. Alternatively, the etching may be discontinued prior to removal of the nanocluster masks, and the masks may be removed via a separate step, such as exposure of $SiO_2$ nanoclusters masks to a buffered oxide etch ("BOE").

Figure 6A:
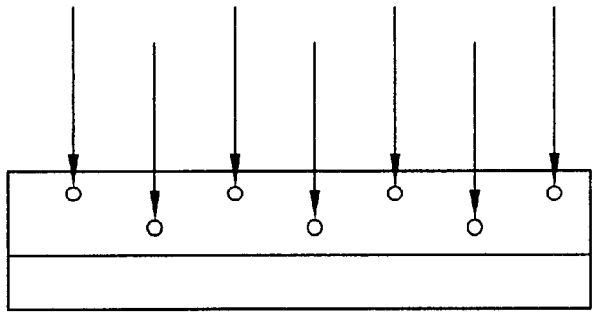
FIGS. 6A–C illustrate a second method for fabricating tiny field emitter tips.
Figure 6B:
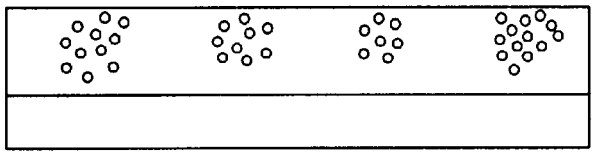
Figure 6C:
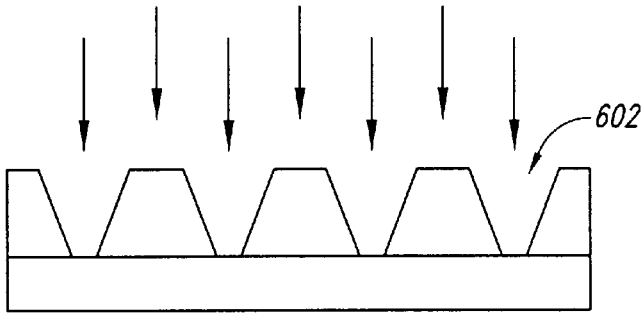

An alternative embodiment for producing tiny field emitter tips across the surface of a substrate material employs preferential etching of nanoclusters. FIGS. 6A–C illustrate, in cross-section, a second method for fabricating tiny field emitter tips. In a first step, illustrated in FIG. 6A, a substrate material is exposed to, or bombarded with, reactive molecular, atomic, ionic, or free radical species to produce nanoclusters of a resulting covalent compound within the substrate, identical or similar to the first step in the first embodiment described with reference to FIGS. 5A–D. Next, as illustrated in FIG. 6B, the substrate is subjected to RTP in order to coalesce nanoclusters and uniformly disperse the coalesced nanoclusters throughout a surface layer of the substrate. This second step is identical to, or similar to, the second step of the first embodiment described with reference to FIG. 5B. However, the third step of the second method is quite different from the third step of the first embodiment. In the first embodiment, the nanoclusters serve as masks to protect substrate material below the nanoclusters from being etched by exposure of the substrate to an etch medium. In the second method, the substrate is exposed to an etch medium that selectively etches the nanoclusters, leaving nascent field emitter tips on the surface of the substrate separated by gaps resulting from selective removal of the nanoclusters. FIG. 6C illustrates nascent field emitter tips, such as nascent field emitter tip 602, resulting from a selective etch of the nanoclusters formed in the first two steps illustrated in FIGS. 6A–B. The selective etch also etches the substrate material, so that over time, the mesa-like field emitter tips are sharpened to produce a final field of tiny field emitter tips as illustrated in FIG. 5D. In the case of $SiO_2$ nanoclusters within a silicon substrate, freon-based plasma etch media, HF vapor etch media, and various wet etch solutions, including acetic acid and $NH_4F$ solutions, can be employed to selectively etch the $SiO_2$. In the case of $Si_3N_4$ nanoclusters, phosphoric acid wet etch solutions, $CF_4$ and freon-based plasma etch media, and other $Si_3N_4$ selective etch media may be employed.

Figure 7:
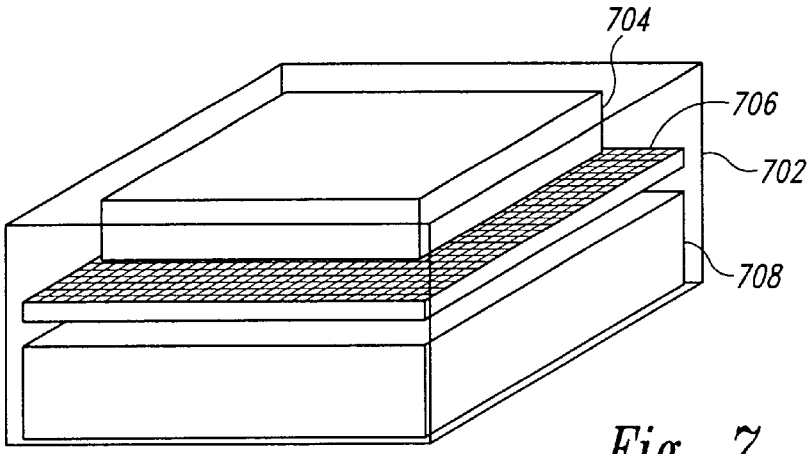
FIG. 7 illustrates an ultra-high density electromechanical memory based on a phase-change storage medium.

Silicon-based field emitter tips are also employed in various types of ultra-high density electronic data storage devices. FIG. 7 illustrates an ultra-high density electromechanical memory based on a phase-change storage medium. The ultra-high density electromechanical memory comprises an air-tight enclosure 702 in which a silicon-based field emitter tip array 704 is mounted, with the field emitter tips vertically oriented in FIG. 7, perpendicular to lower surface (obscured in FIG. 7) of the silicon-based field emitter tip array 704. A phase-change storage medium 706 is positioned below the field emitter tip array, movably mounted to a micromover 708 which is electronically controlled by externally generated signals to precisely position the phase-change storage medium 706 with respect to the field emitter tip array 704. Small, regularly spaced regions of the surface of the phase-change storage medium 706 represent binary bits of memory, with each of two different solid states, or phases, of the phase-change storage medium 706 representing each of two different binary values. A relatively intense electron beam emitted from a field emitter tip can be used to briefly heat the area of the surface of the phase-change storage medium 706 corresponding to a bit to melt the phase-change storage medium underlying the surface. The melted phase-change storage medium may be allowed to cool relatively slowly, by relatively gradually decreasing the intensity of the electron beam to form a crystalline phase, or may be quickly cooled, quenching the melted phase-change storage medium to produce an amorphous phase. The phase of a region of the surface of the phase-change storage medium can be electronically sensed by directing a relatively low intensity electron beam from the field emitter tip onto the region and measuring secondary electron emission or electron backscattering from the region, the degree of secondary electron emission or electron backscattering dependent on the phase of the phase-change storage medium within the region. A partial vacuum is maintained within the air-tight enclosure 702 so that gas molecules do not interfere with emitted electron beams. Dense fields of tiny field emitter tips microfabricated according to the present invention are particularly suitable for application in these ultra high density electronic data storage devices.

Although the present invention has been described in terms of a particular embodiment, it is not intended that the invention be limited to this embodiment. Modifications within the spirit of the invention will be apparent to those skilled in the art. For example, it may be possible to introduce dissolved oxygen into the silicon in which the silicon substrate is cut during crystal growth in order to produce the higher densities of $SiO_2$ nanoclusters. As pointed out above, nanosilicon-based field emitter tips of various sizes and shapes can be produced by controlling the parameters of the ion exposure or ion implantation step, the annealing step, and the final $SiO_2$ etch step. Many different techniques well-known in microchip fabrication can be employed in each of the three steps. Dense fields of silicon-based nano field emitter tips can be prepared on thin silicon substrates that are affixed to the surface of microelectronic circuitry or, by contrast, fields of silicon-based nano field emitter tips can be directly fabricated on the surface of silicon-based microelectronic circuits. Field emitter tips can be fabricated on the surfaces of substrates other than silicon by choosing appropriate materials and method to produce nanoclusters within the substrate that can be etched, or that can mask an etch medium, selectively with respect to the substrate material. Finally, the present invention may be applied for fabrication of other types of silicon nanostructures, and may be generally applied to fabricating a wide variety of different types of nanostructures on the surface of different types of substrates.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purpose of illustration and description. They are not intended to be exhaustive or to limit the invention to the precise forms disclosed. Obviously, many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents:

What is claimed is:

1. A method for producing tiny field emitter tips across the surface of a substrate, the method comprising:

exposing the substrate to an active chemical species in order to create nanoclusters within a surface layer of the substrate; and etching the substrate to create the tiny field emitter tips across the surface of the substrate.

2. The method of claim 1 wherein the substrate is a silicon substrate and wherein the active chemical species is selected from chemical species that include:

oxygen-containing molecules;

ozone;

oxygen-containing ions; and oxygen free radicals.

3. The method of claim 1 wherein the nanoclusters are composed of $SiO_2$ molecules.

4. The method of claim 1 wherein the substrate is a silicon substrate and wherein the active chemical species is selected from chemical species that include:

nitrogen-containing molecules; and nitrogen-containing ions.

5. The method of claim 4 wherein the nanoclusters are composed of $Si_3N_4$ molecules.

6. The method of claim 1 wherein the substrate is exposed to a number of active chemical species in order to create nanoclusters within a surface layer of the substrate, wherein the substrate is a silicon substrate, and wherein the active chemical species is selected from chemical species that include:

oxygen-containing molecules;

ozone;

oxygen-containing ions;

oxygen free radicals;

nitrogen-containing molecules; and nitrogen-containing ions.

7. The method of claim 6 wherein the nanoclusters are composed of molecules containing silicon, oxygen, and nitrogen.

8. The method of claim 1 wherein exposing the substrate to an active chemical species in order to create nanoclusters within a surface layer of the substrate comprises employment of a reactive ion etching technique.

9. The method of claim 1 wherein exposing the substrate to an active chemical species in order to create nanoclusters within a surface layer of the substrate comprises employment of a downstream microwave plasma generation technique.

10. The method of claim 1 wherein exposing the substrate to an active chemical species in order to create nanoclusters within a surface layer of the substrate comprises employment of an electron cyclotron resonance technique.

11. The method of claim 1 wherein, rather than exposing the substrate to an active chemical species, nanoclusters are produced within a surface layer of the substrate during substrate fabrication.

12. The method of claim 1 wherein etching the substrate to create tiny field emitter tips across the surface of the substrate further includes etching the substrate using an etch medium selective for the nanoclusters to remove the nanoclusters, leaving field emitter tips separated by empty spaces created by removal of the nanoclusters.

13. The method of claim 12 wherein the nanoclusters are composed of $Si_3N_4$ and the selective etch medium is selected from among selective etch media including:

phosphoric acid wet etch solutions;

$CF_4$-based plasma etch media; and freon-based plasma etch media.

14. The method of claim 12 wherein the nanoclusters are composed of $SiO_2$ and the selective etch medium is selected from among selective etch media including:

freon-based plasma etch media;

HF vapor etch media; and various wet etch solutions, including acetic acid/$NH_4F$ solutions.

15. The method of claim 1 wherein etching the substrate to create tiny field emitter tips across the surface of the substrate further includes etching the substrate using an etch medium selective for the substrate material, so that the nanoclusters act as masks to inhibit etching of the substrate material underlying the nanoclusters, thereby forming nascent field emitter tips.

16. The method of claim 15 wherein the selective etch medium is a reactive ion etch technique employing a gas mixtures selected from among various gas mixtures including:

$SiH_2Cl_2$, $O_2$ and He;

$SiH_2Cl_2$, $O_2$ and Ar;

$NF_3$, $SiF_4$, $O_2$, and He; and

HBr and Ar.

17. The method of claim 1 further including, prior to etching the substrate, thermally annealing the substrate using a rapid thermal processing technique to coalesce nanoclusters into relatively regularly spaced and sized nanoclusters.

18. The method of claim 1 wherein the nanoclusters are composed of $SiO_2$ and further including, wherein etching the substrate further includes selectively etching the substrate material, and further including, following etching the substrate, removal of remaining cluster material using a buffered oxide etch.

* * * * *